US007654003B2

(12) United States Patent
Simms et al.

(10) Patent No.: US 7,654,003 B2
(45) Date of Patent: Feb. 2, 2010

(54) SAFETY RAZORS WITH CHARGE INDICATOR AND POWER SWITCH

(75) Inventors: Graham John Simms, Reading (GB); Robert Barrett Yates, Ready (GB)

(73) Assignee: The Gillette Company, Boston, MA (US)

( * ) Notice: Subject to any disclaimer, the term of this patent is extended or adjusted under 35 U.S.C. 154(b) by 262 days.

(21) Appl. No.: 11/203,509

(22) Filed: Aug. 12, 2005

(65) Prior Publication Data

US 2006/0032055 A1 Feb. 16, 2006

(51) Int. Cl.
*B26B 19/00* (2006.01)

(52) U.S. Cl. ..... 30/34.05; 30/44; 30/526; 30/541

(58) Field of Classification Search ..... 30/34.05, 30/50, 526, 541, 42–46
See application file for complete search history.

(56) References Cited

U.S. PATENT DOCUMENTS

| | | | | |
|---|---|---|---|---|
| 1,168,288 | A | 1/1916 | Davidson | |
| 1,180,686 | A | 4/1916 | Allport | |
| 1,223,305 | A | 4/1917 | Allport | |
| 1,429,760 | A | 9/1922 | Norquist | |
| 1,440,325 | A | 12/1922 | Wilhelm | |
| 1,554,159 | A | 9/1925 | Hodges | |
| 1,676,183 | A | 7/1928 | Garfunkle | |
| 1,693,348 | A | 11/1928 | Pollifrone | |
| 1,862,274 | A | 6/1932 | Mendelsohn | |
| 1,900,965 | A | 3/1933 | Weiss | |
| 1,950,789 | A | 3/1934 | Eells | |
| 2,225,405 | A | 12/1940 | Osterman | |
| 2,309,035 | A | 1/1943 | Beam | |
| 2,311,439 | A | 2/1943 | Iwanowicz | |
| 2,546,928 | A | 3/1951 | Masabny | |
| 3,329,881 | A * | 7/1967 | Tolmie | 320/114 |
| 3,526,959 | A * | 9/1970 | Young | 30/43.6 |
| 3,610,080 | A * | 10/1971 | Kuris | 83/13 |
| 3,611,568 | A | 10/1971 | Alexander et al. | |

(Continued)

FOREIGN PATENT DOCUMENTS

| | | |
|---|---|---|
| DE | 7728867 | 2/1978 |

(Continued)

OTHER PUBLICATIONS

"Sterling". Job posting on Careerbuilder.com, acessed via search for "design" under category "Engineer" on Sep. 19, 2008.*

(Continued)

*Primary Examiner*—Kenneth E. Peterson
*Assistant Examiner*—Sean Michalski
(74) *Attorney, Agent, or Firm*—Kevin C. Johnson; Steven W. Miller

(57) ABSTRACT

The invention relates to safety razors having blade units carried on a handle, an electrical arrangement including an electrically operated vibration device, and a control device for actuating the vibration device when the blade unit is moved into contact with or into close proximity to the skin of a person holding the razor, a battery accommodated in the handle, a switch for connecting the electrical arrangement to the battery, and optionally, a light emitting diode for illuminating a section of handle neck to indicate that the electrical arrangement is connected to the battery and ready to actuate the vibration device.

5 Claims, 9 Drawing Sheets

U.S. PATENT DOCUMENTS

| | | | | | |
|---|---|---|---|---|---|
| 3,633,089 | A | * | 1/1972 | Dorion et al. | 320/108 |
| 4,094,062 | A | | 6/1978 | Papanikolaou | |
| 4,112,271 | A | | 9/1978 | Marchetti | |
| 4,473,943 | A | | 10/1984 | Papanikolaou | |
| 4,594,777 | A | * | 6/1986 | Kimoto et al. | 30/42 |
| 4,611,400 | A | | 9/1986 | Drake | |
| 4,779,173 | A | | 10/1988 | Carr et al. | |
| 5,046,249 | A | | 9/1991 | Kawara et al. | |
| 5,121,541 | A | | 6/1992 | Patrakis | |
| 5,196,731 | A | * | 3/1993 | Abe et al. | 307/142 |
| 5,214,851 | A | | 6/1993 | Althaus | |
| 5,299,104 | A | | 3/1994 | Parmentier | |
| 5,299,354 | A | | 4/1994 | Metcalf et al. | |
| 5,347,715 | A | | 9/1994 | Friedland | |
| 5,473,519 | A | * | 12/1995 | McCallops et al. | 362/120 |
| 5,582,476 | A | | 12/1996 | Hansen | |
| 5,973,294 | A | * | 10/1999 | Schatt et al. | 219/228 |
| 5,993,440 | A | | 11/1999 | Ghassemi | |
| 6,009,623 | A | | 1/2000 | Orloff | |
| 6,032,365 | A | * | 3/2000 | Hodges | 30/43.6 |
| 6,067,714 | A | | 5/2000 | Taylor et al. | |
| 6,112,414 | A | * | 9/2000 | Andis et al. | 30/231 |
| 6,227,676 | B1 | | 5/2001 | Sneddon | |
| 6,238,076 | B1 | | 5/2001 | Pascale et al. | |
| 6,301,792 | B1 | * | 10/2001 | Speer | 30/541 |
| 6,406,157 | B1 | | 6/2002 | Audet | |
| 6,430,813 | B2 | | 8/2002 | Muraguchi et al. | |
| 6,460,251 | B1 | | 10/2002 | Orloff | |
| 6,481,104 | B1 | | 11/2002 | Parker et al. | |
| 6,497,043 | B1 | | 12/2002 | Jacobsen | |
| 6,533,775 | B1 | | 3/2003 | Rizoiu | |
| 6,634,104 | B2 | | 10/2003 | Jacobsen | |
| 6,836,966 | B2 | * | 1/2005 | Patrick | 30/34.05 |
| 7,028,405 | B2 | * | 4/2006 | Paas et al. | 30/45 |
| 2001/0023538 | A1 | * | 9/2001 | Muraguchi et al. | 30/43.92 |
| 2001/0025421 | A1 | | 10/2001 | Damstra | |
| 2002/0189102 | A1 | | 12/2002 | Orloff | |
| 2003/0167638 | A1 | | 9/2003 | Bader et al. | |
| 2003/0226258 | A1 | | 12/2003 | Patrick | |
| 2004/0083613 | A1 | * | 5/2004 | Andis et al. | 30/34.05 |
| 2005/0034307 | A1 | * | 2/2005 | Brzezinski | 30/34.05 |
| 2008/0209733 | A1 | * | 9/2008 | Johnson | 30/41 |
| 2009/0119924 | A1 | * | 5/2009 | Bozikis | 30/45 |

FOREIGN PATENT DOCUMENTS

| | | | | |
|---|---|---|---|---|
| DE | 201 13379 | U1 | | 12/2001 |
| DE | 202 01 967 | U1 | | 6/2002 |
| DE | 101 38 044 | A1 | | 2/2003 |
| DE | 203 03 081 | U1 | | 8/2003 |
| DE | 10 2005 030 533 | A1 | | 4/2007 |
| EP | 0885698 | | | 12/1998 |
| EP | 0945229 | | | 9/1999 |
| EP | 0906814 | | | 7/2001 |
| FR | 878882 | | | 2/1943 |
| FR | 1046876 | | | 12/1953 |
| GB | 2258922 | | | 2/1993 |
| GB | 2361889 | A | | 7/2001 |
| JP | 401127982 | A | * | 5/1989 |
| RU | 2180880 | C2 | | 3/2002 |
| WO | WO 2006/079863 | A1 | | 8/2006 |

OTHER PUBLICATIONS

"Austin-Allen". Job posing on Careerbuilder.com, acessed via search for "design" under category "Engineer" on Sep. 19, 2008.*

* cited by examiner

SAFETY RAZORS WITH CHARGE INDICATOR AND POWER SWITCH

CROSS REFERENCE TO RELATED APPLICATIONS

This application claims the benefit of priority under 35 U.S.C. § 120 from WO 2004/073936 A1, filed on Feb. 19, 2004, which claims priority from GB 0303865.0, filed on Feb. 19, 2003, the contents of both of which are incorporated herein by reference in their entireties.

TECHNICAL FIELD

This invention relates to safety razors.

BACKGROUND

A safety razor generally includes a handle and a blade unit carried on the handle and including at least one blade with a sharp cutting edge. In the course of shaving the blade unit is applied against the skin and the blade or blades are moved across the skin so that the sharp cutting edges engage and cut through the hairs protruding from the skin.

The blade unit can be fixed on the handle with the intention that the entire razor should be discarded when the cutting edges have become dull and no longer capable of providing a comfortable shave. Alternatively the blade unit may be removably mounted on the handle so that the blade unit can be replaced by a new blade unit when the sharpness of the blades has diminished to an unacceptable level. Replaceable blade units are often referred to as shaving cartridges.

The majority of safety razors currently marketed are operated and used entirely manually. Nonetheless electrical devices can be incorporated in safety razors. For instance, it is known to include an electrically driven vibration mechanism which is operable to vibrate the razor, since it has been observed that such vibration can have a beneficial effect on razor performance. A simple and convenient vibration generating mechanism consists of an electric motor with a weight mounted eccentrically on its output shaft. The vibration mechanism and a battery for providing electric power to the motor can be conveniently housed in the razor handle. Examples of previous proposals for such razors are those described in U.S. Pat. No. 3,611,568, U.S. Pat. No. 5,299,354, U.S. Pat. No. 5,214,851, and U.S. Pat. No. 5,046,249. In U.S. Pat. No. 6,481,104B1 there is disclosed a safety razor housing including a vibration mechanism and a tight emitting diode which is illuminated when the vibration mechanism is turned on. A vibrating razor described in EP-A-0885698 includes a power meter or indication to indicate the battery power remaining and/or to indicate when a new battery is needed.

A vibration mechanism can be adapted to vibrate only one or more selected components of the blade unit, such as the guard which contacts the skin in front of the blades, or one or more blades, and the vibration may be directional, for instance directed lengthwise of the blades to encourage a slicing cutting action or transverse to the blades. Another possibility is for an element to be vibrated in a direction generally perpendicular to the skin surface being shaved. The vibration mechanism may incorporate a piezoelectric device for producing the vibrations, instead of a motor for rotationally driving an eccentric weight.

Other forms of electrical device besides vibration generators can be included in wet razors, some examples of such devices being: (i) heating devices for heating one or more blades or other components of a blade unit which contact the skin during shaving, such as Peltier devices or electrical resistance or ohmic heating devices; (ii) dispensing devices for delivering a shaving enhancement product to the skin and which may be activated by operation of a motor driven pump or by operation of a valve having an electrically controlled actuator, shaving enhancement products which can be delivered at a safety razor blade unit during performance of a shaving stroke including those with the qualities and properties mentioned in our patent application No. WO 00/47374, the contents of which are incorporated herein by reference in their entirety; (iii) conditioning devices to prepare the skin and/or hairs ready to be cut by the blades, such as a roller mounted in the region of the guard of the blade unit and adapted to be rotated about its axis for encouraging hairs tying against the skin to stand up for cutting; iv) illumination devices for illuminating an area of skin being shaved; and v) actuators for adjusting the blade unit in accordance with prevailing shaving conditions detected by a sensor.

In EP-A-0906814 and U.S. Publication No. 2002/0189102 there are described razors with force sensors and electronically activated indicates to signal that blade replacement is necessary. There is described in GB-A-2258922 a personal care apparatus such as a hair dryer or electric toothbrush that is mains operated and includes an indicator to show that the apparatus is connected to the AC source. There is a capacitive sensor in the handle so that the apparatus is activated as soon as it is picked up in the hand.

When there is an electrical device included in a safety razor it is often convenient for the device to be operated by a replaceable or rechargeable electric storage battery that can be housed within the razor handle. To conserve battery power it is preferable for the electrical device to be disconnected from the battery during periods when the razor is not in use. In some cases it may be immediately obvious to a user when connection between the electrical device and battery is established, such as if the device is a vibration generator which is set into operation as soon as the electrical connection to the battery is made, but there may be other examples where it is not so obvious.

SUMMARY

In accordance with the present invention there is provided a safety razor including a blade unit carried on a handle, an electrical arrangement including an electrically operated device, and an indicator, wherein the electrically operated device is actuatable by the electrical arrangement during shaving, and the indicator produces a signal for indicating to a razor user that the electrical arrangement is connected to a source of electrical power and ready for actuation of the device.

As well as providing the user with a clear indication that the razor is ready and operational, the indicator will signal to a user not familiar with the razor that something can be expected to happen and hence take away the sudden shock which could be caused, such as by an unexpected movement of a razor component.

In certain embodiments, the indicator includes a light emitting device, and in particular a light emitting diode. In another embodiment, a low frequency and/or low amplitude oscillation indicates that the razor is operational. In yet another embodiment, an audible signal, i.e., a sound or tone, indicates that the razor is operational. Any combination of these indicators can also be utilized.

The indicator can be conveniently located on a neck of the razor handle that interconnects the blade unit with a gripping portion of the handle.

The handle can include a light transmitting section illuminated by the light emitting device. The light transmitting section can extend around the entire periphery of the neck and along at least a major part of the neck. Since the neck is not usually covered by the hand of the user, with a relatively large part of the neck becoming illuminated a very clear and unmistakable indication is given to the user that the razor is ready for use.

A power switch can be included to control connection of the electrical arrangement with the power source, and the indicator can be arranged to be energized by the power source when the power switch is closed. A manually operated power switch can be used, but then the razor user must remember to turn the power supply on and off at appropriate times for proper operation of the electrical device and to ensure that electrical energy is not consumed unnecessarily. Therefore, in certain embodiments the power switch is arranged to be operated to connect the power source to the electrical arrangement by separation of the razor from a holder on which the razor is stored during periods of non-use. The power switch is conveniently included in the handle of the razor and can be a mechanical switch positioned on the handle to be actuated by engagement with and disengagement from the razor holder. In another embodiment, the power switch is magnetically actuable, for example a reed switch, and the razor holder includes a magnet for the switch to be operated when the razor is separated from and placed onto the razor holder.

The razor holder is preferably arranged to grip the handle at or adjacent to the location of the power switch, which can help in assuring proper operation of the power switch. The razor holder may have the form of a tray for the razor to lie on, e.g., of the general form described in U.S. Pat. No. 5,782,346.

In certain embodiments the electrical arrangement includes, in addition to the electrical device actuatable during shaving, a switching device to control operation of the electrical device in response to a predetermined condition being sensed by the switching device, more especially the blade unit being brought into contact with, or into close proximity to, the skin surface of a person holding the razor, and/or the blade unit being immersed into a body of water for cleaning the blade unit. When the power switch is turned on to supply power to the switching device from the power supply, such as a battery that can be conveniently housed in the handle, but power is not delivered to the electrical device the razor will be in a standby mode and fully prepared for use, and this standby mode is clearly signalled to the user by the indicator.

The indicator can be arranged to generate a modified signal when battery power is low. For example, if the indicator includes a light emitting device, it can be arranged to flash. Alternatively, a further light emitting device can be included for producing a "battery low" signal.

The invention is specifically described hereinbelow with reference to an embodiment in which the electrical device controlled by the switching device is a vibration generator, more particularly a motor with an eccentric weight fastened to its output shaft. Other forms of electrical device, including those mentioned herein above can be provided alternatively or additionally.

In addition, a timing device can be provided to interrupt the supply of power to the electrical arrangement if the razor is not returned to the razor holder within a certain period of time after being removed from the razor holder. A timing device helps avoid unnecessary expenditure of energy if a razor user fails to return the razor to the holder after use. The turning device can be re-settable by placing the razor on the holder once again.

DESCRIPTION OF DRAWINGS

To facilitate a clear understanding of the invention, an embodiment is described in detail below with reference to the accompanying drawings, in which.

Like reference symbols in the various drawings indicate like elements.

DETAILED DESCRIPTION

Figure 1:
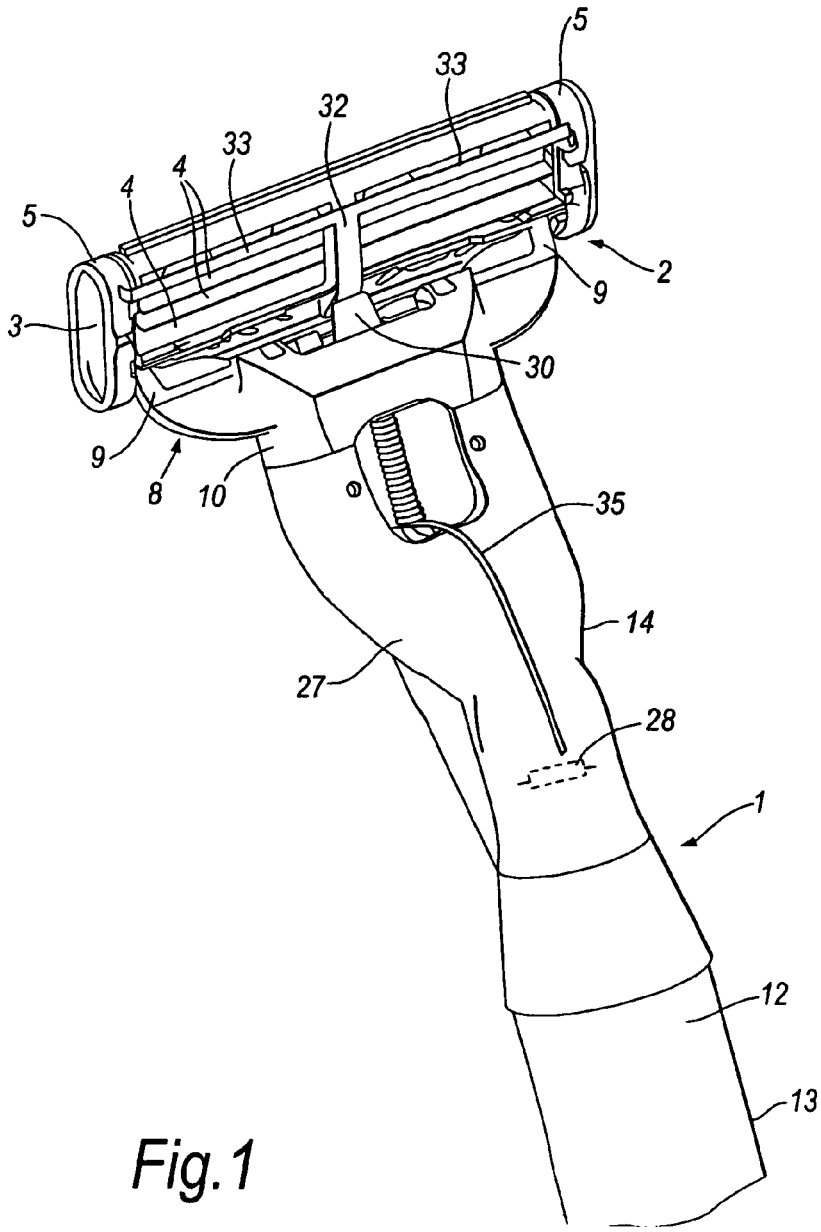
FIG. 1 is a partial isometric view of the razor illustrating the blade unit and an upper portion of the handle as seen from the rear.

The safety razor illustrated in the drawings has a handle 1 and a blade unit or cartridge 2 detachably mounted on the upper end of the handle. The blade unit 2 includes a generally rectangular frame 3, and a plurality, e.g., 3, 4 or 5, blades 4 with substantially parallel sharp cutting edges, disposed in the frame and held in place by metal clips 5 positioned around the frame 3 at the opposite ends of the blade unit 2. A guard structure including a strip of elastomeric material is provided on the frame for contacting the skin in front of the blades, and a cap structure including a lubricating strip is provided on the frame for contacting the skin behind the blades during the performance of a shaving stroke. The frame is pivotally carried on a yoke member 8 having a pair of arms 9 which extend from a hub 10 and are journalled in opposite ends of the frame 2 so that the blade unit 2 can pivot relative to the handle 1 about an axis substantially parallel to the blade edges. The hub 10 is connected detachably to the end of the handle 1. As so-far described the razor is of a known construction and for further details reference may be made to earlier patent publications, one example of which is WO97/37819, the contents of which are incorporated herein by reference in their entirety.

The razor handle includes a main portion 12 intended to be gripped in the hand and a neck 14 extending upwardly from the main portion and to the free end of which the blade unit 2 is attached. The main or gripping portion 12 of the handle 1 includes an electrically conductive, e.g., metal, casing 13 which serves as an electrode for electrical contact with the hand of a user as described in more detail below. Housed within a battery compartment in the handle is a replaceable or rechargeable battery 15, which constitutes a power supply for an electronic switching device 16 also accommodated within the handle.

Figure 3:
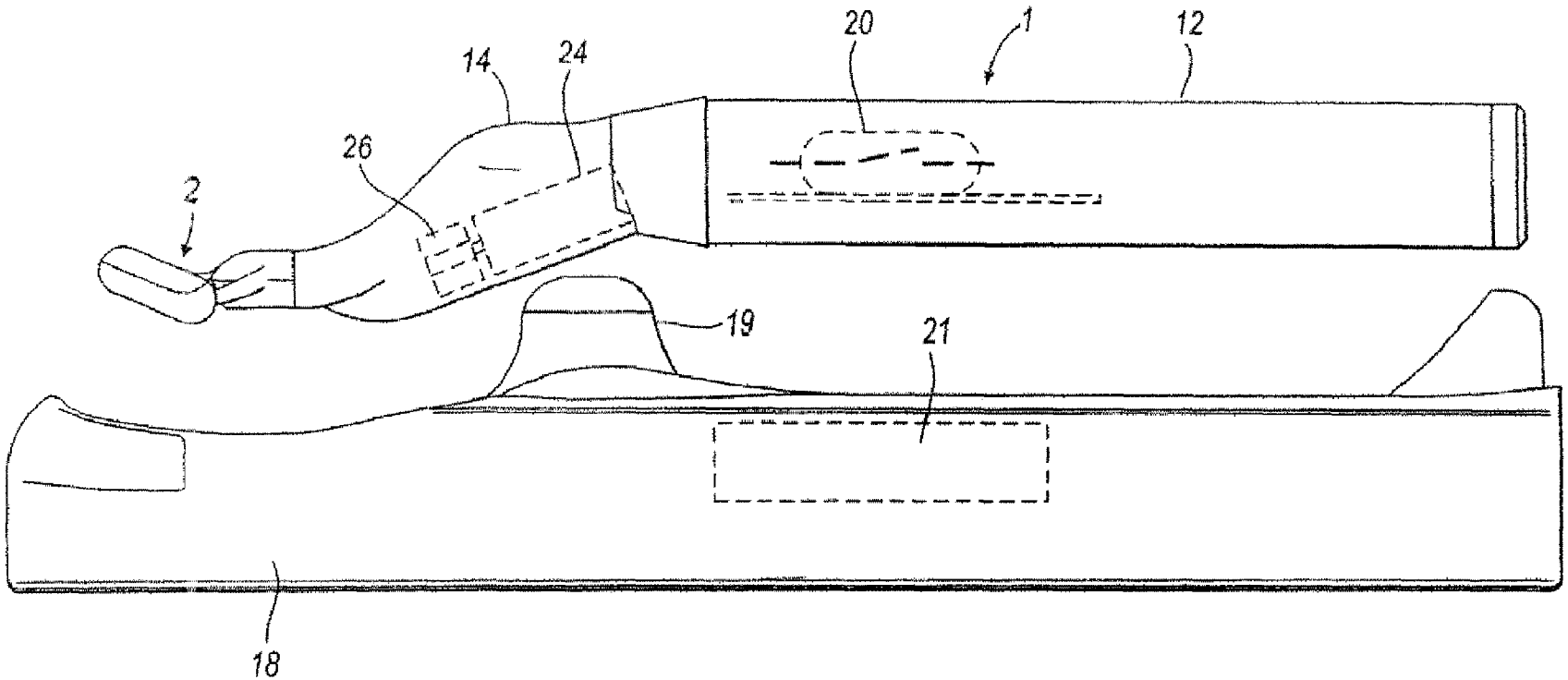
FIG. 3 is a side elevation showing a razor holder in the form of a tray on which the razor is stored during periods of non-use, the razor being shown separated from the storage tray at a small distance.
Figure 4:
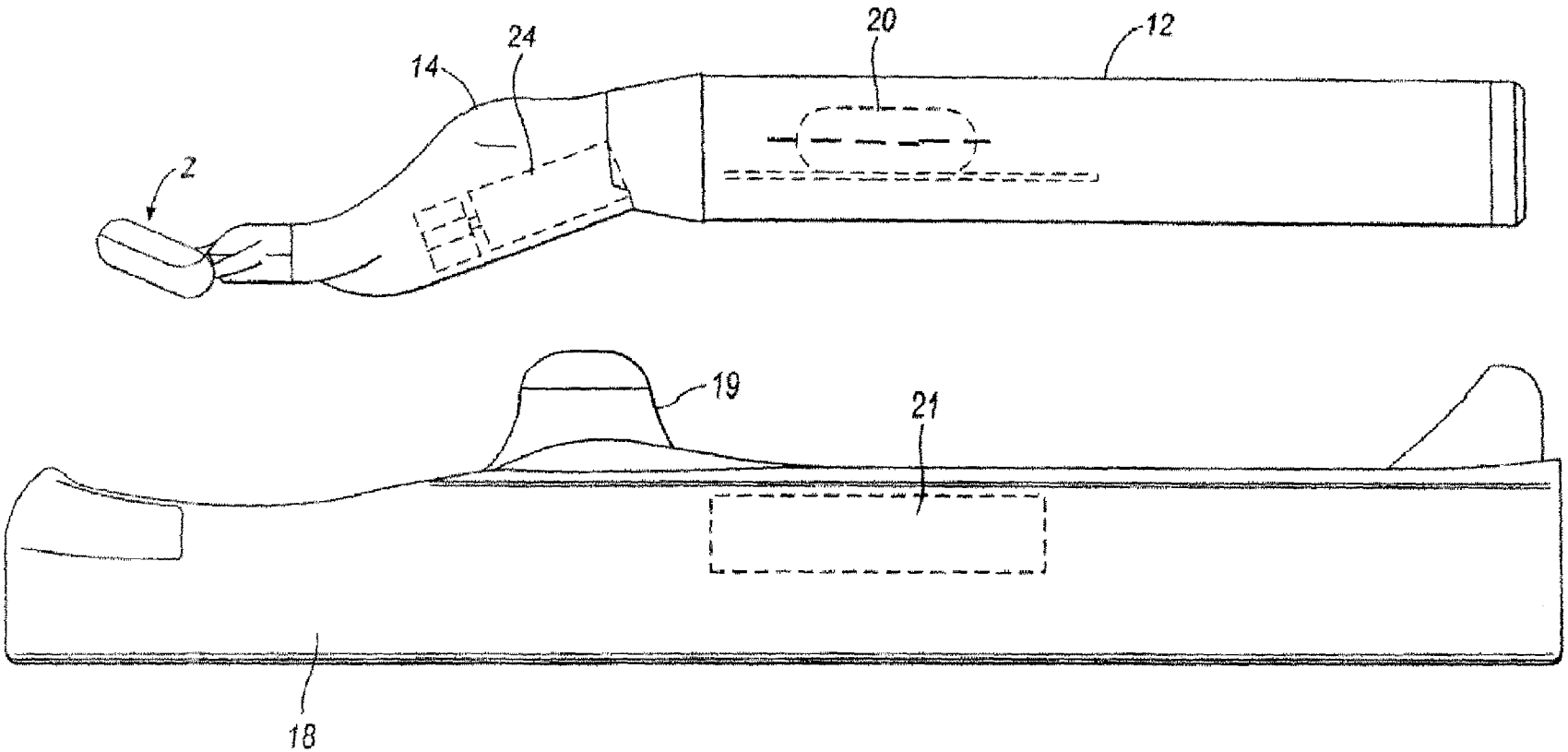
FIG. 4 is a side elevation corresponding to claim 3, but showing me razor at a greater distance form the storage tray.
Figure 5:
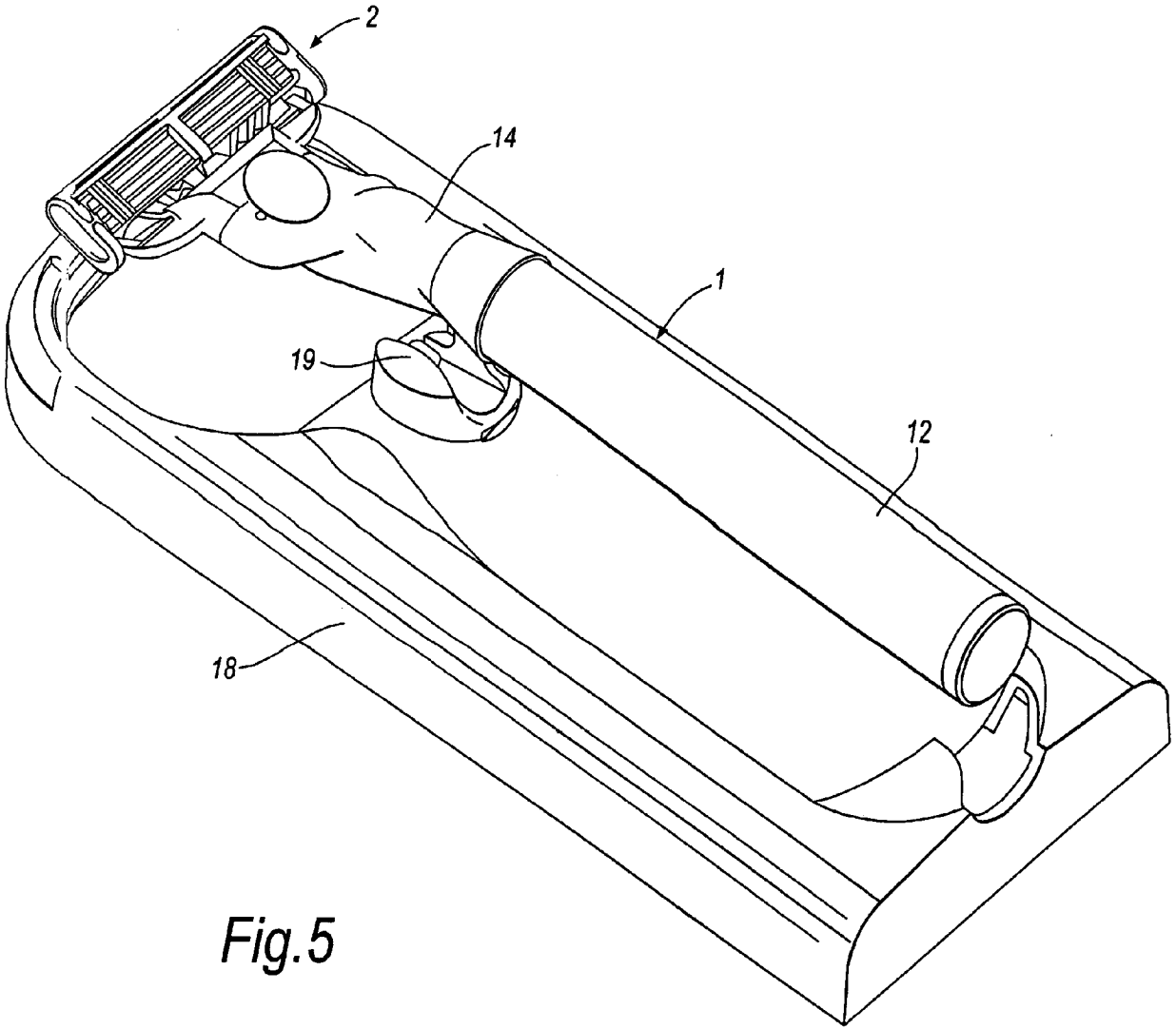
FIG. 5 shows the razor and storage tray of FIG. 3 in an isometric view.
Figure 6:
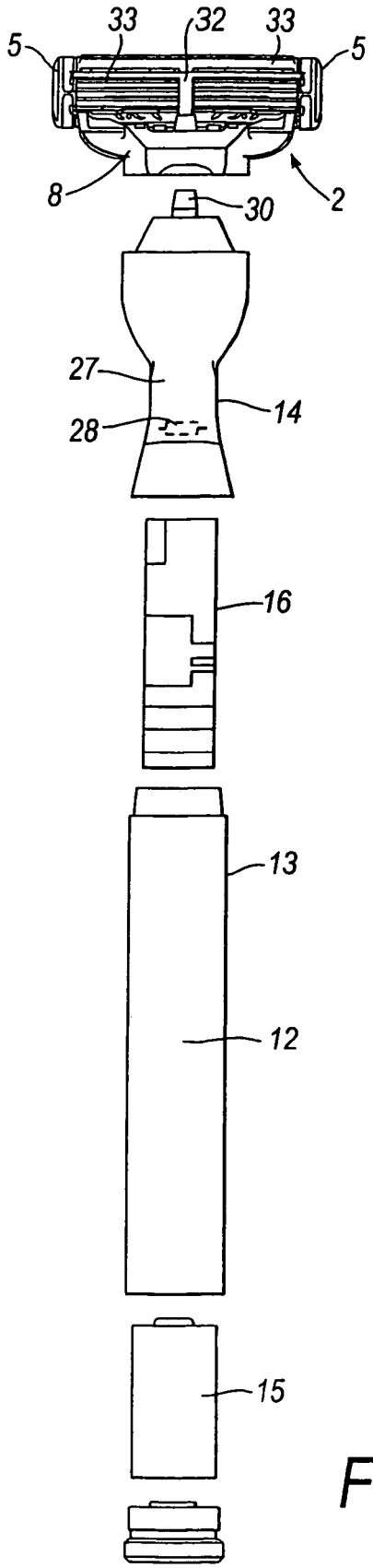
FIG. 6 is an exploded rear elevation of the razor.
Figure 7:
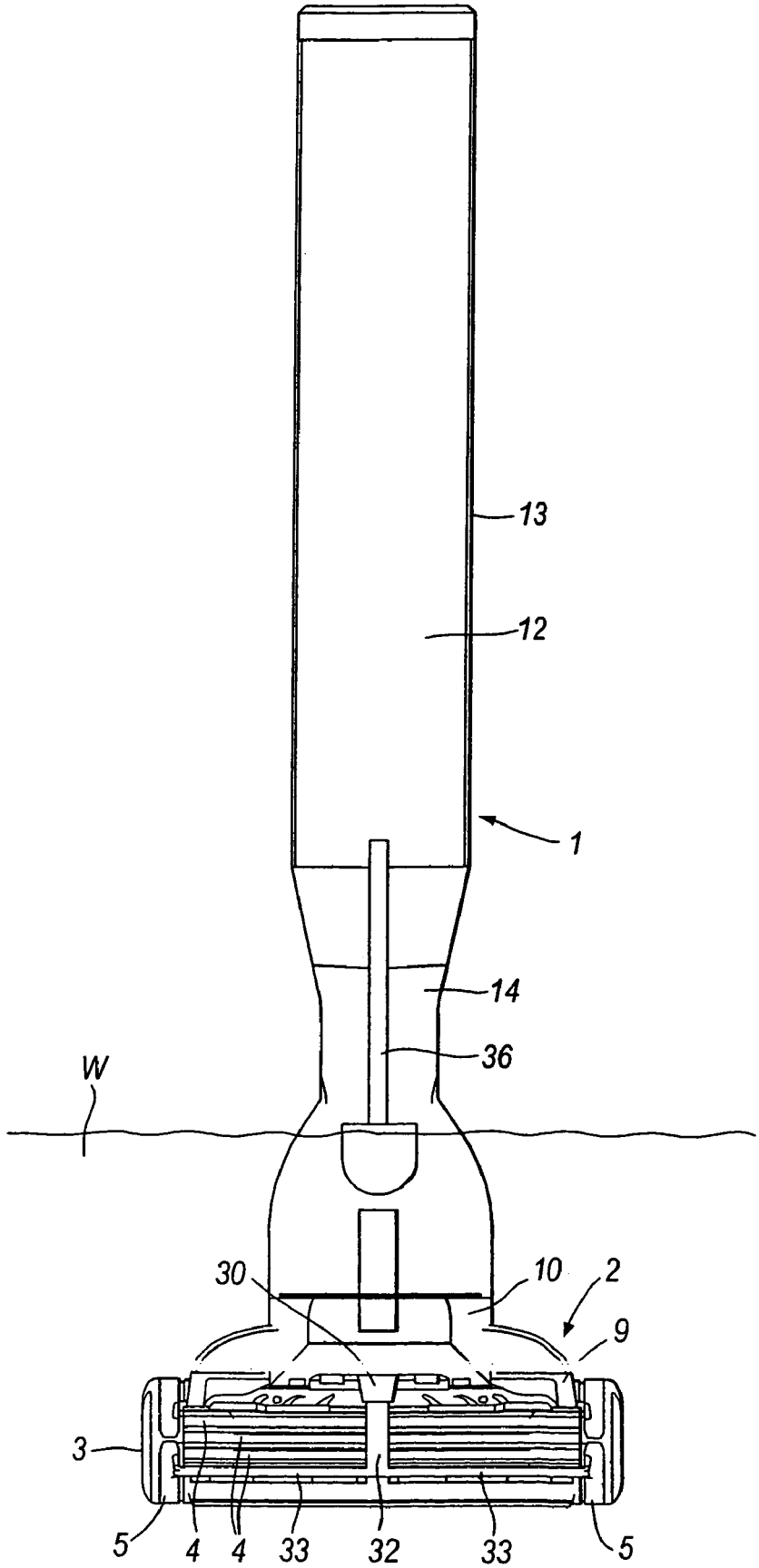
FIG. 7 is a rear elevation of the razor illustrating an additional element of the water detecting arrangement.

In accordance with the present invention, the battery 15 is electrically connected to the switching device 16 through a power switch that is operable to interrupt power supply to the switching device for conserving battery energy during periods when the razor is not being used. The power switch could be located on the handle for manual operation, but in a useful construction the power switch is arranged to be actuated by removing the razor from, and returning it to, a razor holder on which the razor is intended to be stored when not in use. A known form of razor holder consists of a tray 18 as shown in FIGS. 3-5, the tray 18 having on its upper side a saddle 19 adapted to receive and lightly grip the neck 14 of the razor handle 1.

The razor handle 1 could be equipped with a mechanical switch so arranged for cooperation with the storage tray 18 that the switch is operated automatically when the razor is lifted away from the storage tray 18 for power to be supplied to the switching device 16 from the battery 15, and to be actuated upon replacement of the razor on the tray to interrupt the power supply. In certain embodiments, essentially the same result is achieved by a power switch in the form of a reed switch 20 located within the handle 1, the storage tray 18 being provided with a permanent magnet 21. The magnet is located in a position close to the saddle 19, and the reed switch is disposed in the handle 1 at or adjacent to the portion of me neck 14 adapted to be gripped in the saddle. When the razor is positioned close to the tray 18 the reed switch 20 is held open and there is no electrical power supply from the battery 15, as shown in FIG. 3, but when the razor is moved away from the tray the reed switch 20 closes and electrical power supply to the switching device 16 is established.

Figure 2:
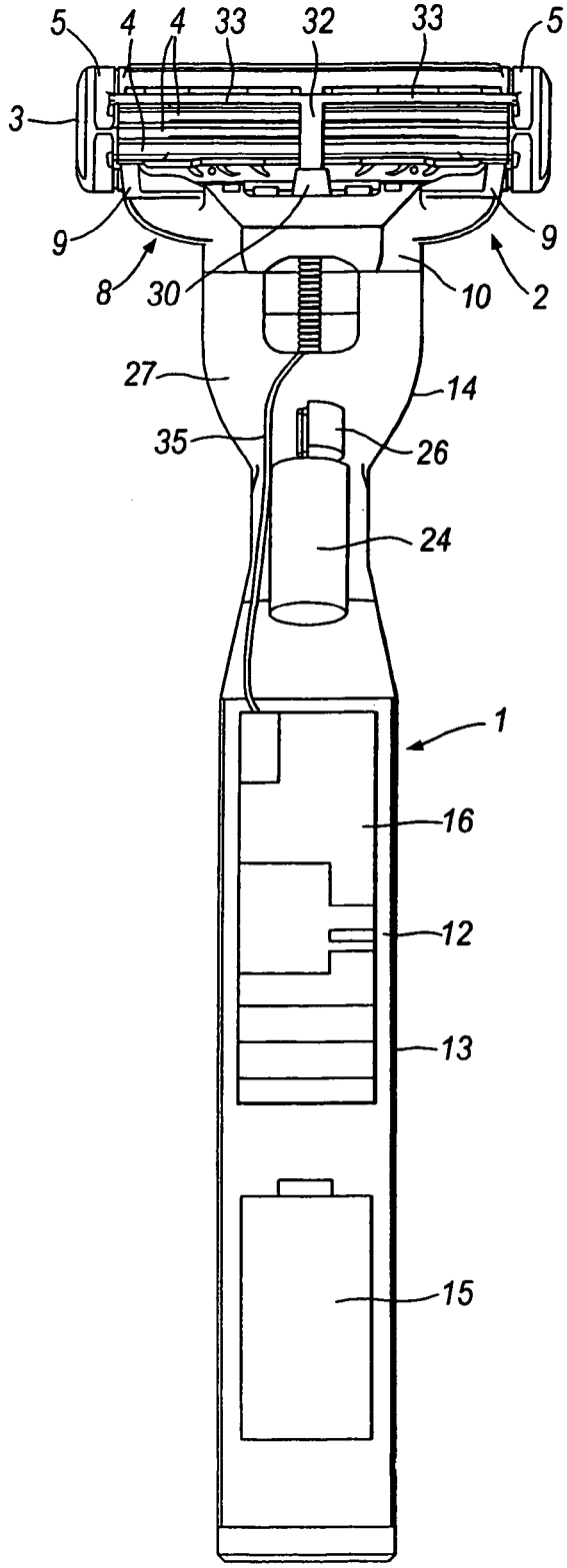
FIG. 2 shows the razor in rear elevation.

The switching device 16, in a manner described in detail below, controls actuation of an electric motor 24 (FIGS. 2 and 3) housed within the handle 1 and having an output shaft with an eccentric weight 26 fastened thereon. In a manner known per se, energization of the electric motor results in a high speed rotation of the eccentric weight 26 and thereby vibration of the razor, and the blade unit 2 in particular. A suitable vibration frequency is around 120 Hz.

The neck 14 of the handle includes a transparent section 27 which extends around the entire periphery of the neck and along a major part of the length of the neck. Positioned within the handle for illuminating this transparent neck section 27, preferably with light of a distinctive color, e.g., blue light, is a light emitting diode 28. The led 28 is energized when the reed switch 20 is closed and the switching device 16 receives electric power from the battery. The energization of the led 28 results in the internal illumination of the neck section 27 which then takes on a softly glowing external visual appearance, thereby providing the razor user with an unmistakable, highly visible, indication that electrical supply to the switch device 16 has been established and the razor is ready to be used.

The blade unit 2 incorporates an electrode which is conveniently constituted by at least one or all of the blades 4 of the blade unit. Electrical connection between the switching device and this electrode 4 is achieved by the neck 14 of the handle 1 having a contact 30 arranged to projectmrough me hub iu of me yoke member 6 and to bear against a contact strip 32 fixed to the rear of the blade unit 2, the contact strip 32 having lateral wings 33 which extends to and are conductively connected to the metal blade retention clips 5, and these clips in turn having contact with blades 4. Of course, it is not essential to use the blades 4 as an electrode and a separate electrically conductive element could be provided on the blade unit in a position for contacting the skin when the blade unit 2 performs a shaving stroke. The contact 30 makes constant electrical contact with the contact strip 32 so that the electrical continuity between the electrode at the blade unit is not interrupted even during pivoting of the blade unit 2 on the handle 1 as tends to occur as the blade unit is applied to and moved across the skin. The contact 30 conveniently takes the form of a spring-loaded plunger for resisting pivotal movement of the blade unit away from a predetermined rest position. The contact 30 is shown connected electrically to the switching device 16 by a wire conductor 35, which is led through the neck 14 of the handle 1.

Of course, there are other possibilities to ensure electrical connection of the electrode on the blade unit and the switching device. For example, the frame 3 of the blade unit could be made of an electrically conductive material, such as a conductive plastic. Also the rear of the frame 3 could be plated, coated, or printed with conductive material, have an adhesive metal foil applied to it, or have a metal element embedded therein, to provide electrical connection between the contact 30 and the clips 5, or to the electrode itself or another component in contact with the electrode. Alternatively, the frame may include an injection molded metal part to provide the conductive path between the electrode and the contact 30, or water held in capillary grooves may be sufficient to ensure the electrical continuity.

Figure 8:
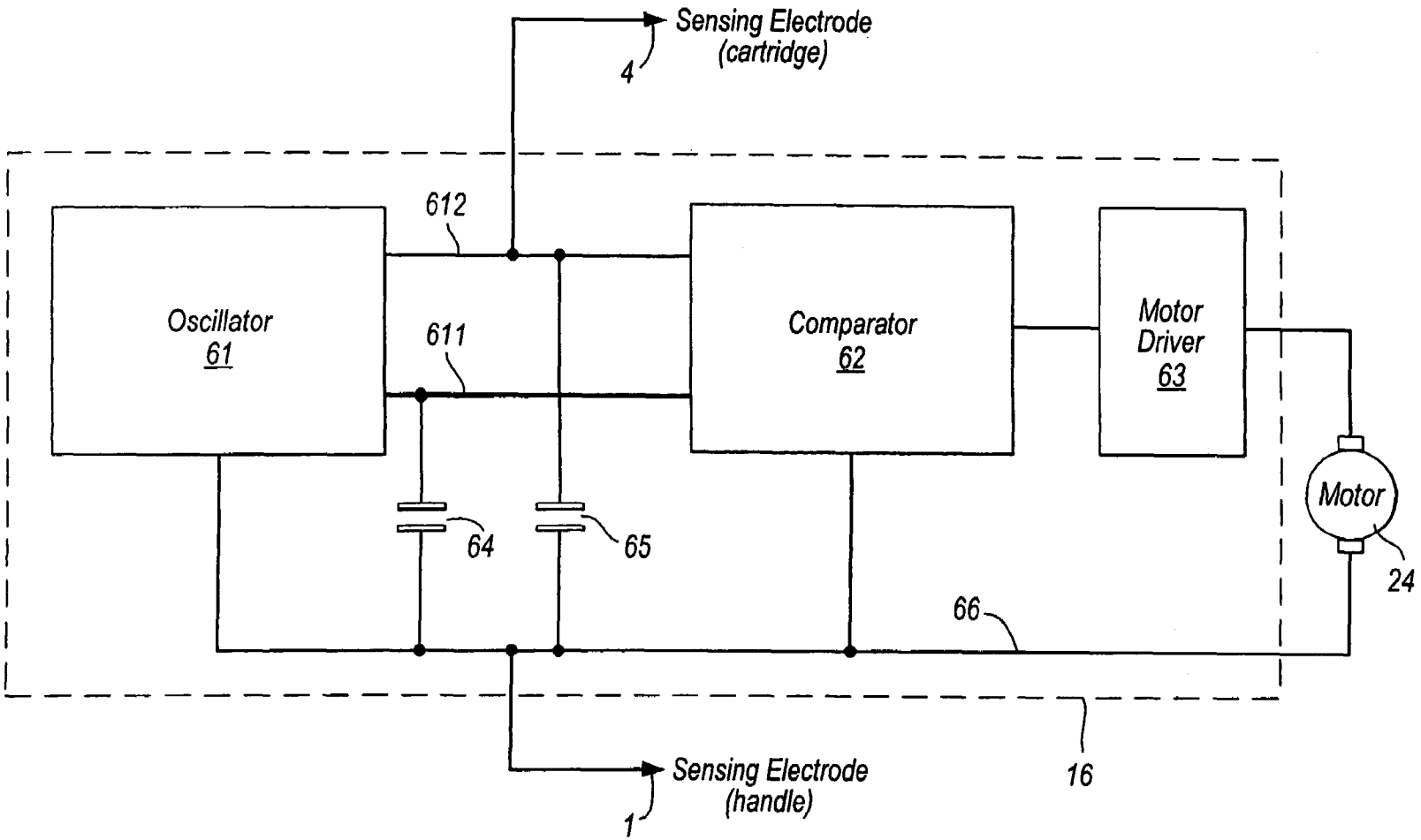
FIG. 8 is a block diagram of an electronic switching device incorporated in the razor.
Figure 9:
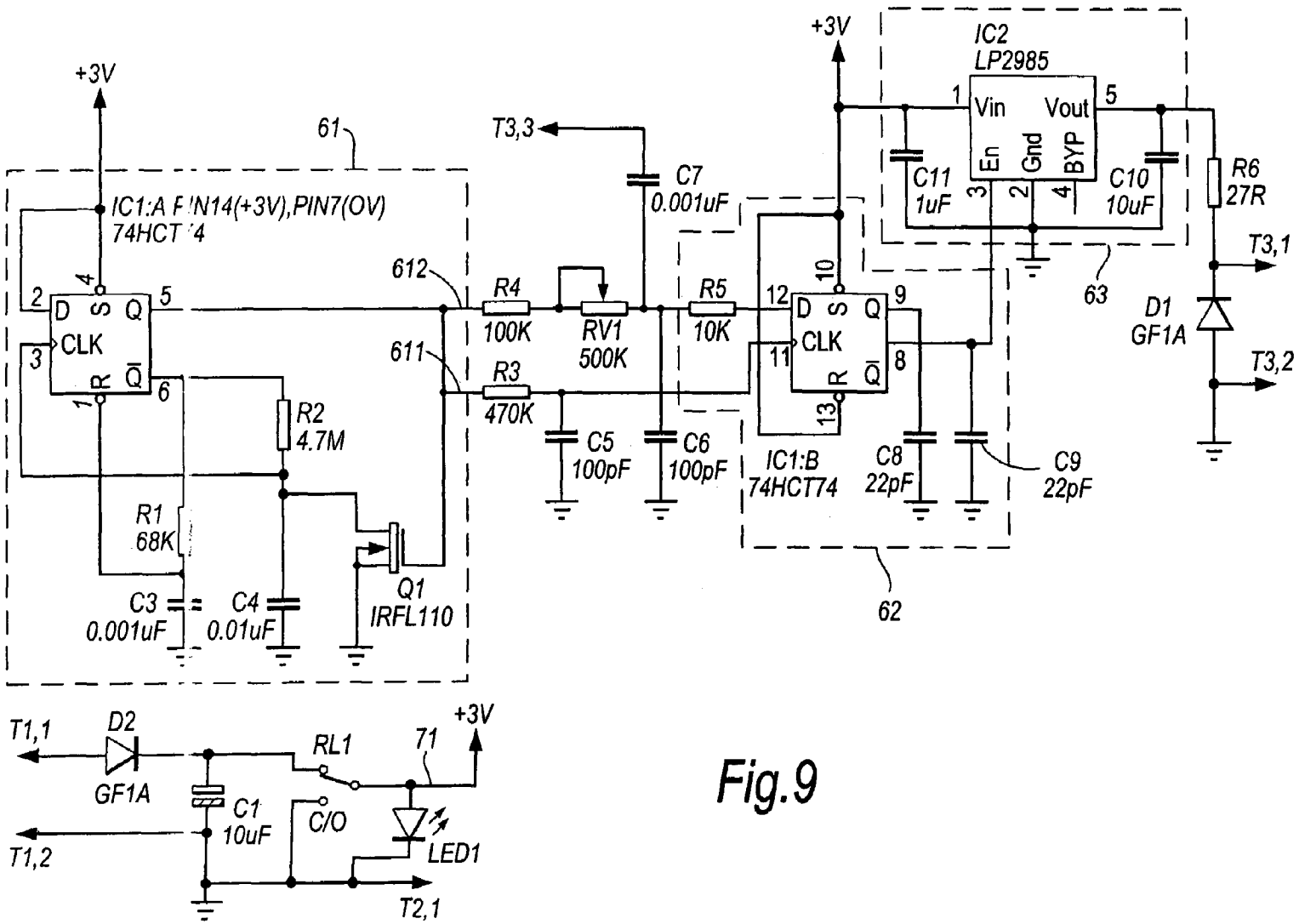
FIG. 9 shows an example of a specific embodiment of a switching circuit.

It is possible for the switching device 16 to be arranged to determine when the blade unit is immersed in water by sensing an electrical parameter between the electrode 4 on the blade unit 2 and the electrode formed by the metal casing 13 of the handle gripping portion 12. It is not necessarily essential for the blade unit 2 to be plunged into water so deeply that the water must contact the handle gripping portion 12 for the immersion of the blade unit into the water to be detected, as may be the case if it is known the body of water will be connected to earth and the casing of the gripping portion handle will also be connected to earth, such as by the razor user. As illustrated in FIG. 8, however, the razor includes a water detection probe 36 that extends along the exterior of the neck 14 of the handle. The probe 36 is electrically conductive and serves as an electrode, or an electrode extension in as much that is can be electrically connected to the metal casing 13 of the handle gripping portion 12. A separate electrical connection between the probe 36 and the switching device 16 can alternatively be used.

The switching device 16 senses an electrical parameter, which may be electrical resistance or capacitance, between the blade electrode 4 and the probe electrode 36, and is responsive thereto to actuate the electric motor 24 to activate the vibration generator 26 when the blade unit 2 is immersed into a body of water W so that both electrodes make contact with the water. The switching device operates to turn off the power supply to the motor 24 when the blade unit 2 is lifted out of the water W. The operation of the switching device 16 is described in detail below. In certain embodiments, the switching device 16 also functions as a touch sensitive device so that the motor 24 is actuated to drive the vibration generating eccentric weight 26 when a person holding the razor by the handle touches the blade unit 2 against the skin surface, e.g., at the start of a shaving stroke.

Vibrating the blade unit as is moves across the skin can have a beneficial effect on the shaving performance. However, as soon as the blade unit is lifted away from the skin surface the vibration stops. It has been found that the discomfort perceived by users of vibrating razors applies for the most part only when the razor is held within blade unit away from the body in free space and by having vibration occur only when the razor is actually shaving and during rinsing of the blade unit, the user prejudices against vibrating razors are mostly eliminated.

As described above, the control device functions so that the motor 24 stops immediately when the blade unit of the razor is moved out of contact with the skin. This is not essential and the control device can be arranged to provide a short delay of up to a few seconds, e.g., around 0.1 to 0.5 seconds, before turning off the power supply to the motor after contact between the blade unit and the skin-of the user is interrupted, which may be beneficial in maintaining the vibration of the razor between shaving strokes performed in quick succession.

It should be understood that the foregoing description of the various embodiments, is given by way of non-limiting example only and that modifications are possible without departing from the scope of the invention as defined by the claims which follow. As an example of one possible modification, the conductive casing 13 of the handle could be provided with a thin covering layer of insulating material so that there is a high capacitance and high resistance coupling between the hand of the user and the handle electrode. Furthermore, if desired a manually operable switch mechanism can be included on the razor handle and be connected electronically in series with the switch 20, for use by a user who prefers not to use the storage tray for holding the razor when it is not being used. This switch, or a different manually operable switch, such as-an electronic toggle switch which-turns on and/or off after a certain delay, may be included in order to allow the razor user to select a non-vibrating mode for example when trimming hair in awkward areas.

OTHER EMBODIMENTS

A number of embodiments of the invention have been described. Nevertheless, it will be understood that various modifications may be made without departing from the spirit and scope of the invention.

What is claimed is:

1. A safety razor comprising;

a blade unit carried on a handle, the blade unit comprising a plurality of elongated blades including substantially parallel sharp cutting edges disposed between a cap structure and a guard structure;

an electrical arrangement comprising an electrically operated device; and an indicator, wherein the electrically operated device is actuatable by the electrical arrangement during shaving, and the indicator produces a signal for indicating to a razor user that the electrical arrangement is connected to a source of electrical power and is ready for actuation of the device by a user;

a power switch to control connection of a switching device with the source of electrical power, the indicator being energized by the source of electrical power only when the power switch is closed in response to the razor being separated from a holder on which the razor is stored during periods of non-use; and the switching device is arranged to connect the source of electrical power to the electrical arrangement in response to activation by a user.

2. A safety razor of claim 1, wherein the indicator comprises a light emitting device.

3. A safety razor of claim 2, wherein the light emitting device is housed in the handle and the handle comprises a light transmitting section arranged to be illuminated by the light emitting device.

4. A safety razor of claim 3, wherein the handle comprises a gripping portion and a neck disposed between the gripping portion and the blade unit, and wherein the light transmitting section forms part of the neck.

5. A safety razor of claim 4, wherein the light transmitting section extends around the entire periphery of the neck.

* * * * *